United States Patent [19]

Pillman et al.

[11] 4,401,211

[45] Aug. 30, 1983

[54] MULTIPLE CONTAINER CARRIER AND PACKAGE

[75] Inventors: Harry F. Pillman, Barrington; H. Carl Recknagel, Arlington Heights, both of Ill.

[73] Assignee: Illinois Tool Works Inc., Chicago, Ill.

[21] Appl. No.: 435,002

[22] Filed: Oct. 18, 1982

[51] Int. Cl.[3] ..... B65D 75/00

[52] U.S. Cl. ..... 206/150; 206/158

[58] Field of Search ..... 206/150, 151, 148, 158, 206/145, 161

[56] References Cited

U.S. PATENT DOCUMENTS

| | | | |
|---|---|---|---|
| 4,033,457 | 7/1977 | Weaver | 206/150 |
| 4,109,787 | 8/1978 | Klygis et al. | 206/150 |
| 4,330,058 | 5/1980 | Klygis | 206/150 |
| 4,356,914 | 11/1980 | Olsen et al. | 206/150 |

*Primary Examiner*—Joseph Man-Fu Moy

*Attorney, Agent, or Firm*—Thomas W. Buckman

[57] ABSTRACT

A sheet-like, thermoplastic multi-packaging device for an array of generally cylindrical containers and a multi-package created by such a device. At least one side of the device, namely the side designed to be in tight stretching contact with the container, being of a matte finish so that the device and container will not bind or adhere, thus permitting relative movement between the surfaces.

7 Claims, 6 Drawing Figures

MULTIPLE CONTAINER CARRIER AND PACKAGE

BACKGROUND AND SUMMARY OF THE INVENTION

This invention pertains to multi-packages for a plurality of containers, such as cans, which are held together by a carrier device. These devices are typically sheet-like with apertures formed creating a plurality of integrally connected bands which are particularly designed and dimensioned to by stretchingly applied around the top region of a can.

Various forms of carriers of the type referred to are shown in U.S. Pat. Nos. 2,874,835, 3,874,502, 4,018,331 and 4,219,117.

Such devices have become thinner and of less total material content through a variety of improvements in designs and have accordingly been designed to be stretched a significant amount in order to create a stable and integral package.

Carrier devices of the type described are typically manufactured by extruding sheet thermoplastic material, for example low density polyethylene, in thicknesses generally in the range of 0.012–0.030 inches. In typical plastic extruding operations, as the sheet is extruded, it is fed through a series of sizing and/or cooling rolls which are of a rather smooth finish consistent with conventional plastics manufacture.

The standard roll finish and resulting surface finish of the carrier is generally in the range of three to eight RMS (root mean square), which is a standard measurement unit for surface texture and an indication of how rough or smooth such a surface is. More recently, the instruments that are calibrated in RMS have given way to instruments that are calibrated for arithmetic average as a unit of height for roughness or as a unit for measuring surface finish. This RMS measurement and arithmetic average or roughness average is typically given in micro-inches. For example, a surface with a roughness average of 16, means that the surface has an arithmetical average absolute deviation from a means surface of 16 micro-inches (Mu in.).

A typical carrier device of the type described with a surface finish in the range of three to eight RMS, in conjunction with very high stretching forces, creates an extremely close fiting surface-to-surface contact between the carrier device and the can surface, especially when the surface finish of the can is in the same smooth surface finish range.

In certain instances this smooth finish/high stretch force creates a binding or adhering between the carrier and the can, particularly if sugar or any other sticky substance remains entrapped between the carrier device and the can.

In situations where a highly stretched carrier is adhered to a can, any attempt to rotate the can or to move the can relative to the carrier will create an excessive localized stress on the carrier and will likely break the carrier band or locally "neck-down" or stretch the band beyond its elastic limit.

It is accordingly an object of this invention to create a new and novel carrier which will permit relative rotation of a can within the carrier band without binding.

A further object of the invention is to create a carrier device and package which is manufactured with a surface texture sufficiently rough to prevent the deleterious close surface-to-surface contact between the carrier and the package.

The objects and advantages are found in the present invention which utilizes a surface finish in the range of at least 16–18 in roughness average, at least on the side of the carrier that contacts the container. This is to be contrasted with the standard, well-known and conventionally utilized surface finishes in the range of three to eight roughness average.

Other objects and features of the invention will be apparent upon perusal of the hereinafter following specification taken in conjunction with the drawings.

DETAILED DESCRIPTION OF THE PREFERRED EMBODIMENTS

Figure 2:
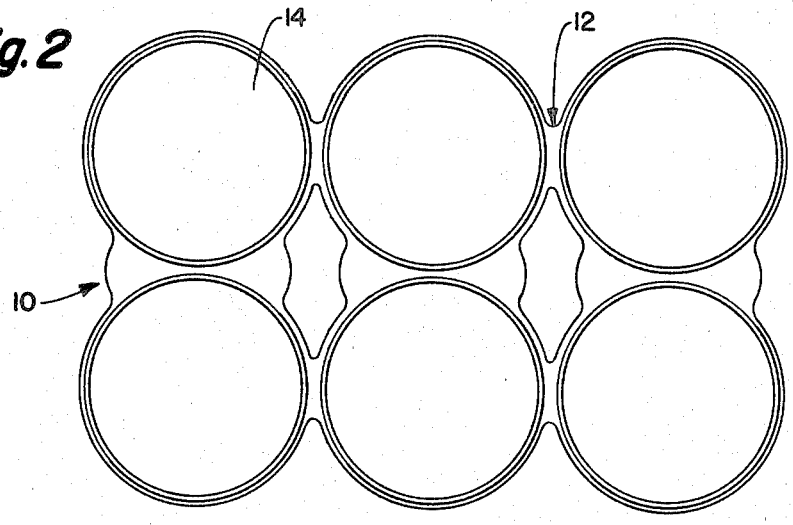
FIG. 2 is a top plan view of the package of FIG. 1.
Figure 1:
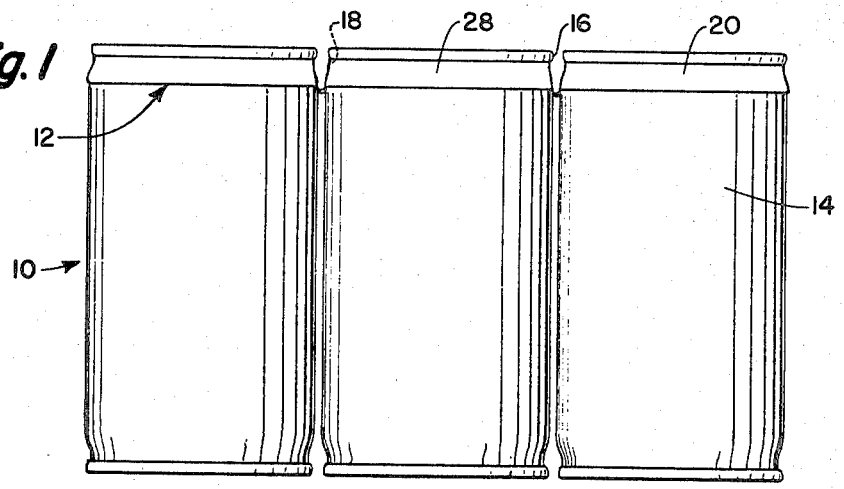
FIG. 1 is a side elevational view of a package made in accordance with this invention.

A multi-package 10 shown in FIGS. 1 and 2 is typical of the type of package that is created by this invention. In a manner similar to the types of carrier described above, the package 10 will include a thermoplastic sheet-like carrier device 12 preferably of a polyethylene material that is extruded and punched to create a plurality of bands 20 about can receiving apertures 22. The bands 20 are interconnected by first web means 24 connecting longitudinally aligned bands creating rows and second web means 26 connecting laterally aligned pairs of bands creating ranks. Thus, in the preferred embodiment, two rows of three ranks of bands are shown which form a "six-pack".

It should be understood for purposes of this invention that the package and carrier device described in this invention are not at all limited to the two rows of three ranks arrays but could be any variety of arrays of bands desired to create an acceptable and feasible package.

Figure 3:
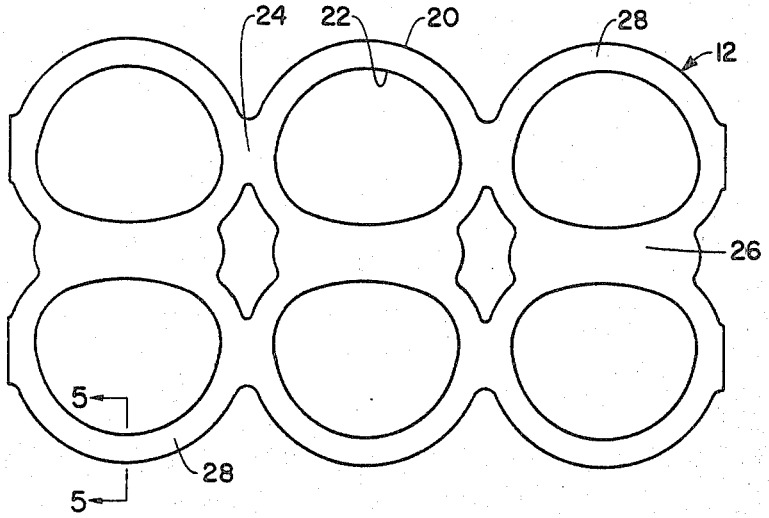
FIG. 3 is a plan view of one embodiment of the carrier device of the subject invention.

It should be noted from viewing FIGS. 1, 2 and 3 that the bands 20 are stretched significantly beyond their original perimeter dimension and preferably at least 15% to create the proper holding force. In a manner typical of carriers of this type, the bands are designed to be deformed out of the plane of the carrier device to form a cylindrical or frusto-conical surface which closely conforms to and provides tight surface-to-surface engagement with a region 18 of a container 14. While a preferred location for such a device is directly beneath a chime 16, it should be understood that similar problems arise wherever the bands of the device are located on the cans. Again, for purposes of this description, the containers 14 shown in FIGS. 1 and 2 are of typical necked-in variety wherein the carrier band is totally conforming to the profile of the necked-in regions 18 of the can.

Figure 4:
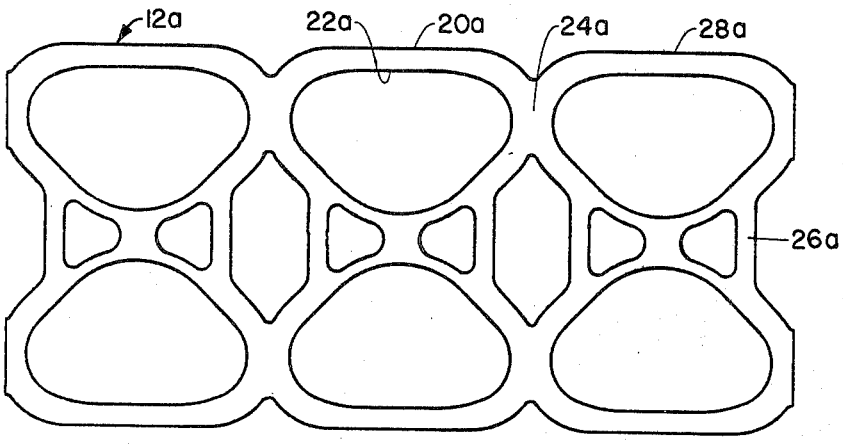
FIG. 4 is a plan view of another embodiment of the carrier device in accordance with the subject invention.

As shown in FIGS. 3 and 4, a carrier will be defined as including an upper or top surface 28 or a lower or bottom surface 30. In a typical application, it is the lower surface of the carrier that is in conforming surface-to-surface contact with the cans.

The two different carrier embodiments shown in FIGS. 3 and 4 will be the same with like elements identified with the suffix "a".

As discussed earlier herein, a typical surface texture or smoothness of a carrier device 12 or 12*a* is identified as being in the range of three to eight RMS, which would relate generally to the same range of roughness if the instruments are calibrated in roughness average. It has, however, been found that instruments calibrated in RMS will read approximately 11% higher on a given surface than those calibrated by arithmetic average or roughness average.

Figure 5:
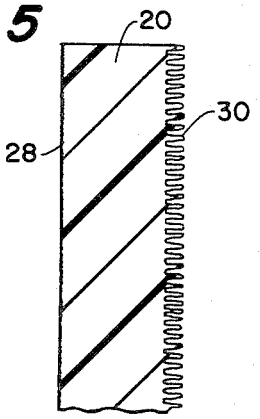
FIG. 5 is a greatly exaggerated, enlarged sectional view of the carrier device as taken through Lines 5—5 of FIG. 3.

Reference to FIG. 5 will show the lower surface 30 in greatly exaggerated form and of estimated configuration being of a matte finish with a surface roughness of approximately two to three times of the standard surface roughness. For example, a matte finish for this invention is defined as a surface roughness in the range of 16–18 in roughness average. This surface finish on the carrier, in conjunction with a dissimilar surface finish on the can, typically in the range of 3–8 surface roughness, reduces the tendency for pure surface-to-surface contact between the carrier, which is highly stretched, and the container. The higher roughness average of the carrier will prevent or tend to prevent the adhesion of the surface of the carrier to the surface of the container, particularly if the container or the carrier has a foreign substance which would tend to act as a binding agent or an adherent, such as sugar.

Figure 6:
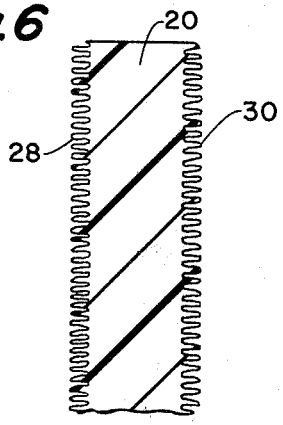
FIG. 6 is a view similar to FIG. 5 showing both surfaces of a carrier provided with a roughened or matte finish.

It may also be preferable, for ease of handling and avoidance of orientation, for both the upper surface 28 and lower surface 30 to be of the matte finish described herein. This embodment is shown in FIG. 6.

Applicant has found that carriers manufactured with the surface finish of the type described will have the same tension or stretching force applied to the regions of the cans, and therefore will not harm the package integrity, but still will permit the rotation of cans relative to the carrier bands without a weakening or necked-in region of the carrier.

This feature becomes important if packagers of product prefer to rotate the cans within the package to make sure that the labels or legends on the containers are properly oriented. As one would tend to rotate one can relative to the rest of the package, it is important to insure that the concentrated forces tending to rotate the container within the confines of the highly stretched band will not localize the forces on the band to the extent that they will rupture or neck-in the band.

Applicant has shown two embodiments of the carrier, namely those in FIGS. 3 and 4, which could utilize the surface texture features of this invention. These examples are exemplary and are no means limiting the invention. FIG. 4 is shown as an example of a carrier which has been weight reduced to the point where there is much smaller surface area of band or carrier device in total for a given dimension of can. It is this type of carrier that the invention is particularly useful in, but as noted above, the invention has utility and usefulness in all styles of carrier, including carriers that are not designed for purely two lane strips; and thus, it is intended that the invention will cover carrier styles such as shown in the above referenced U.S. Pat. No. 4,018,331 which describes a three-lane device.

Having described the invention it should be understood that changes can be made in the described embodiments by one skilled in the art within the spirit and scope of the hereinafter referred to claims.

We claim:

1. A multi-package comprising a plurality of containers arranged in a closely spaced array, each container having substantially cylindrical side-walls and including chime means at an extremity defined as a top extremity, a carrier device formed from a resilient deformable plastic sheet material, elastically gripping predetermined regions of the side-walls of the containers and unitizing them into said array, the device including a plurality of bands interconnected by web means, each of the bands stretchingly gripping a container in a predetermined region beneath a chime, each band further being stretched at least approximately 15% of its original unstretched dimension so that a flat surface region of each band is in tight surface area to surface area contact with the predetermined region on the container, the surface of the band which is in stretching contact with said predetermined region having a surface finish which is not less than approximately 16–18 in roughness average.

2. The multi-package of claim 1 wherein the package comprises an array with a plurality of rows and a plurality of ranks.

3. The multi-package of claim 1 wherein the carrier device is positioned near the top extremities of the cans directly beneath the chimes.

4. The multi-package of claim 1 wherein the predetermined region of the can has a surface finish smoother than the surface finish of the carrier device.

5. A multi-packaging device for resiliently unitizing an array of cylindrical containers in adjacent rows and ranks, said device formed from an elastic plastic sheet material and comprising interconnected bands lying in the plane of the sheet material, each band creating a container receiving aperture, the initial circumferential dimension of each aperture being at least approximately 15% less than the circumferential dimension of the container to which it is to be resiliently associated, the flat surface side of the bands which is designed to be in stretching contact with the container having a matte surface finish which is not less than approximately 16–18 in roughness average.

6. The multi-packaging device in claim 5 wherein both flat surface sides of the bands have a matte surface finish not less than approximately 16–18 in roughness average.

7. The multi-packaging device of claim 5 wherein the elastic plastic sheet material is extruded polyethylene with a thickness range of 0.012–0.030 inches.

* * * * *